US009199817B2

(12) United States Patent
Osaki

(10) Patent No.: US 9,199,817 B2
(45) Date of Patent: Dec. 1, 2015

(54) MEDIUM DISCHARGING APPARATUS AND IMAGE FORMING APPARATUS

(75) Inventor: Koji Osaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/198,832

(22) Filed: Aug. 5, 2011

(65) Prior Publication Data

US 2012/0038101 A1 Feb. 16, 2012

(30) Foreign Application Priority Data

Aug. 10, 2010 (JP) ..... 2010-179769

(51) Int. Cl.

| | |
|---|---|
| ***B65H 29/70*** | (2006.01) |
| ***B65H 31/02*** | (2006.01) |
| ***B65H 31/26*** | (2006.01) |
| ***G03G 15/00*** | (2006.01) |

(52) U.S. Cl.

CPC ..... *B65H 31/26* (2013.01); *B65H 29/70* (2013.01); *B65H 31/02* (2013.01); *G03G 15/6552* (2013.01); *B65H 2301/5133* (2013.01); *B65H 2404/63* (2013.01); *B65H 2801/06* (2013.01)

(58) Field of Classification Search

CPC ..... B65H 29/70; B65H 31/02; B65H 31/26
USPC ..... 271/209, 220, 208, 207; 399/405, 406
See application file for complete search history.

(56) References Cited

U.S. PATENT DOCUMENTS

| | | | | |
|---|---|---|---|---|
| 4,824,091 | A * | 4/1989 | Knight | 271/178 |
| 4,951,935 | A * | 8/1990 | Oikawa | 271/208 |
| 5,033,731 | A * | 7/1991 | Looney | 271/176 |
| 7,055,818 | B2 * | 6/2006 | Furusawa | 271/220 |
| 7,549,622 | B2 * | 6/2009 | Butikofer | 271/3.15 |

(Continued)

FOREIGN PATENT DOCUMENTS

| | | |
|---|---|---|
| JP | H03-110065 U | 11/1991 |
| JP | H04-129958 A | 4/1992 |

(Continued)

*Primary Examiner* — Luis A Gonzalez
(74) *Attorney, Agent, or Firm* — Panitch Schwarze Belisario & Nadel LLP

(57) ABSTRACT

A medium discharging apparatus includes a pair of discharging rollers, a stacker, and a pressing member. The pair of discharging rollers are configured to rotate to discharge a sheet of medium held therebetween. The discharged sheet of medium and are stacked onto the stacker. The pressing member is disposed downstream of the discharging rollers with respect to a path into which the medium is discharged by the discharging rollers. The pressing member is configured to traverse the path and to swing about a shaft due to a gravity force thereof. When the sheet of medium is discharged by the discharging rollers, the pressing member interferes with the sheet of medium and exerts the gravity force on the sheet of medium downward toward the stacker while swinging about the shaft.

27 Claims, 6 Drawing Sheets

(56) References Cited

U.S. PATENT DOCUMENTS

| | | | | |
|---|---|---|---|---|
| 7,850,298 | B2 * | 12/2010 | Ono et al. | 347/104 |
| 8,087,666 | B2 * | 1/2012 | Honda et al. | 271/220 |
| 8,210,528 | B2 * | 7/2012 | Yamaguchi | 271/209 |
| 8,579,280 | B2 * | 11/2013 | Ishikuro | 271/186 |
| 8,594,556 | B2 * | 11/2013 | Ito | 399/405 |
| 8,734,038 | B2 * | 5/2014 | Nakamura et al. | 400/602 |
| 2004/0080739 | A1 * | 4/2004 | Sekiyama et al. | 355/407 |
| 2006/0244804 | A1 * | 11/2006 | Ono et al. | 347/104 |
| 2007/0069454 | A1 * | 3/2007 | Ino | 271/220 |
| 2008/0044214 | A1 * | 2/2008 | Nakajima | 399/406 |
| 2009/0214279 | A1 * | 8/2009 | Ito | 399/405 |
| 2009/0295061 | A1 * | 12/2009 | Honda et al. | 271/3.14 |
| 2011/0198801 | A1 * | 8/2011 | Yamaguchi | 271/207 |

FOREIGN PATENT DOCUMENTS

| | | | |
|---|---|---|---|
| JP | 2003-081514 | A | 3/2003 |
| JP | 2004-115254 | A | 4/2004 |
| JP | 2005-263354 | A | 9/2005 |
| JP | 2006-306544 | A | 11/2006 |
| JP | 2006-306559 | A | 11/2006 |
| JP | 2007-106524 | A | 4/2007 |
| JP | 2009-202965 | A | 9/2009 |

* cited by examiner

MEDIUM DISCHARGING APPARATUS AND IMAGE FORMING APPARATUS

BACKGROUND OF THE INVENTION

1. Field of the Invention

The present invention relates to a medium discharging apparatus and an image forming apparatus to which the medium apparatus is installed.

2. Description of the Related Art

Existing electrophotographic image forming apparatus include printers, copying machines, facsimile machines, and multifunction peripherals. For example, a printer includes an image forming unit that incorporates an LED head, a photoconductive drum, a developing unit, and a transfer unit. The LED head illuminates the charged surface of the photoconductive drum to form an electrostatic latent image on the charged surface. The developing roller supplies toner to the electrostatic latent image to develop the electrostatic latent image with the toner, thereby forming a toner image. The toner image is then transferred by a transfer roller onto a medium, for example, paper.

The paper is fed from a paper cassette to a registry roller, which in turn corrects skew of the paper before feeding the paper to a transfer point defined between the image forming unit and the transfer roller. After the toner image is transferred onto the paper, the paper advances to a fixing unit where the toner image is fixed under pressure and heat. The paper is then discharged onto a stacker.

Since the paper is heated to fuse the toner thereon, the paper may curl after fixing due to the heat and pressure applied thereto.

If sheets of curled paper are stacked on the stacker, the turned-up trailing end portion may interfere with the leading edge of the following sheet discharged from the fixing unit. The leading end of the following sheet may push the trailing end portion of the preceding sheet, causing the preceding sheet to fall off the stacker.

One way of solving this drawback is to employ a film sheet disposed over the exit of the fixing unit, the sheet of film pushing down the raised trailing end portion of the discharged paper.

When the lower end portion of the film sheet interferes with the trailing end portion of the paper, the film is resiliently deformed so that a force is exerted on the raised trailing end portion of the paper. The force varies depending on the mounting location of the film, the warp of the film and the like. This makes it difficult to exert a proper force on the curled trailing end portion of the paper.

As a result, the force may not be exerted on the paper laterally evenly so that the sheets of paper may be discharged with some skew therein.

SUMMARY OF THE INVENTION

The present invention was made in view of the above-described drawbacks.

A medium discharging apparatus includes a pair of discharging rollers, a stacker, and a pressing member. The pair of discharging rollers are configured to rotate to discharge a sheet of medium held therebetween. The discharged sheet of medium and are stacked onto the stacker. The pressing member is disposed downstream of the discharging rollers with respect to a path into which the medium is discharged by the discharging rollers. The pressing member is configured to traverse the path and to swing about a shaft due to a gravity force thereof. When the sheet of medium is discharged by the discharging rollers, the pressing member interferes with the sheet of medium and exerts the gravity force on the sheet of medium downward toward the stacker while swinging about the shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of an image forming apparatus according to the invention will be described with reference to the accompanying drawings by way of an example of a printer.

First Embodiment

Figure 1:
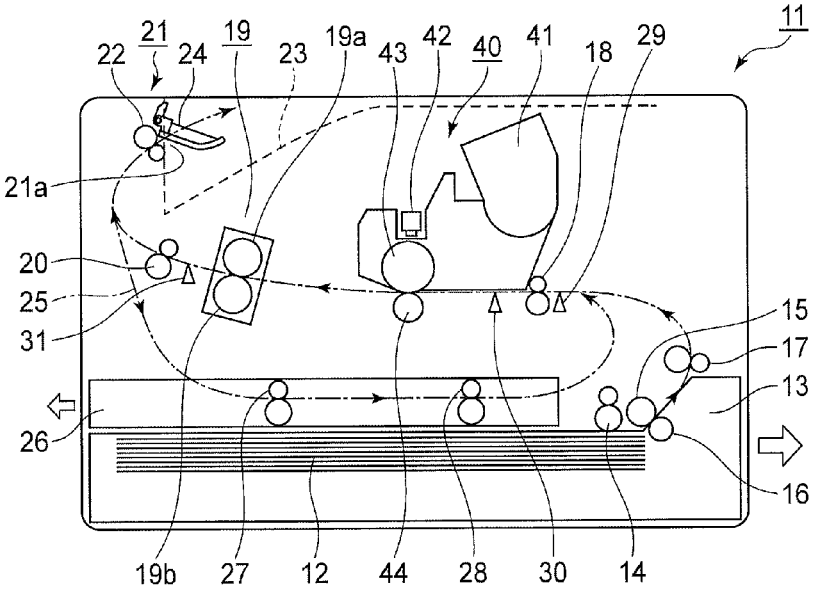
FIG. 1 illustrates the outline of a printer 11 of a first embodiment.
Figure 2:
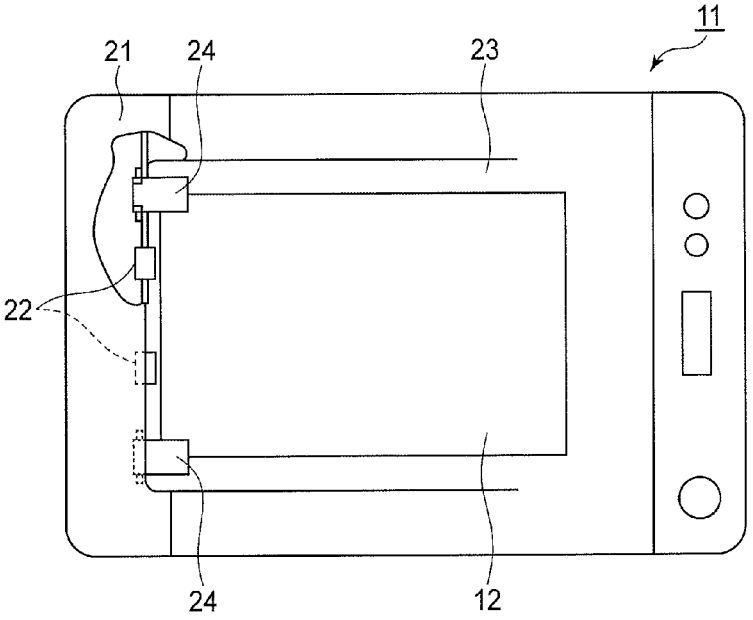
FIG. 2 is a top view of the printer.

FIG. 1 illustrates the outline of a printer 11 of a first embodiment. FIG. 2 is a top view of the printer 11.

A paper cassette 13 is detachably attached to the lower portion of the printer 11, and holds a stack of medium, for example, paper 12 therein. A pick-up roller 14 is disposed over the paper cassette 13, and feeds the paper 12 on a sheet-by-sheet basis when rotated. A feed roller 15 and a retard roller 16 are disposed immediately downstream of the pick-up roller 14 with respect to the transport path of the paper 12. A pair of transport rollers 17 is disposed down stream of the feed roller 15 and retard roller 16. A registry roller 18 is located downstream of the pair of transport rollers 17, and feeds the paper 12 into an image forming unit 40.

The image forming unit 40 includes a toner cartridge 41, a photoconductive drum 43, a charging roller (not shown), and a developing unit (not shown). The toner cartridge 41 holds a developer material or toner therein. The charging roller rotates in contact with the photoconductive drum 43, charging the surface of the photoconductive drum 43. The image forming unit 40 further includes an exposing unit or an LED head 42 and a transfer member or a transfer roller 44. The LED head 42 illuminates the charged surface of the photoconductive drum 43 to form an electrostatic latent image thereon.

The paper 12 is fed from the paper cassette 13 into the transport path, and is transported to the registry roller 18, which in turn corrects skew of the paper 12 before feeding the paper 12 into a transfer point defined between the photoconductive drum 43 and the transfer roller 44.

The LED head 42 illuminates the charged surface of the photoconductive drum 43 to form an electrostatic latent image in the surface. The developing unit 40 supplies the toner to the electrostatic latent image to form a toner image on the photoconductive drum 43. The toner image is then transferred by the transfer roller 44 onto the paper 12.

A fixing unit 19 is located downstream of the image forming unit 40. The fixing unit 19 includes a heat roller 19*a* and, a pressure roller 19*b* in pressure contact with the heat roller 19*a*. When the paper 12 passes through the fixing point defined between the heat roller 19*a* and pressure roller 19*b*, the toner image is fused and pressed against the paper, thereby forming a permanent image.

A pair of transport rollers 20 is disposed downstream of the fixing unit 19. A pair of discharge rollers 22 includes a roller 22*a* that rotates about an axis X1 and a roller 22*b* that rotates about an axis X2. The axes X1 and X2 lie in a plane extending obliquely upwardly. The discharge rollers 22 are located downstream of the pair of transport rollers 20 but immediately upstream of a paper exit 21*a* defined by a part of the chassis of the printer 11. The rotation of the discharge rollers 22 causes the paper 12, sandwiched between the discharge rollers 22, to advance to a stacker 23 outside of the printer 11.

Sensors 29-31 are disposed along the transport path immediately upstream of the registry roller 18, between the registry roller 18 and the transfer roller 44, and between the fixing unit 19 and the pair of transport rollers 20. The sensors 29-31 detect the position of the paper 12 in the transport path.

The printer 11 of the invention supports duplex printing, and therefore the discharge rollers 22 are configured to rotate in contact with each other in a forward direction and in a reverse direction while holding the paper 12 therebetween. In other words, after the paper 12 is printed on its one side, the discharge rollers 22 rotates in the reverse direction to advance the paper 12 into a duplex paper path 25 in which the paper is turned over and is then re-fed to the normal paper path. An image is then printed on the other side of the paper 12. The duplex paper path 25 is a horizontal path defined in a router 26 detachably attached to a portion above the paper cassette 13. The router 26 includes a pair of transport rollers 27 and another pair of transport rollers 28.

When the paper 12 passes through the fixing unit 19, the paper 12 is heated under pressure. This fixing process may cause the paper 12 to curl after fixing the toner image thereon. The curled paper 12 is then discharged onto the stacker 23 with its trailing end portions curved upward or downward.

As a result, the leading edge of the following sheet of the paper 12 tends to push the preceding sheet of the paper 12, causing the preceding sheet to fall off the stacker 23. This decreases the capacity of the stacker to support the paper 12.

In order to solve this drawback, a pair of flaps 24 is disposed at a discharge port 21, pressing down the trailing end portion of the paper 12.

FIG. 2 is a top view of the printer 11. The flaps 24 are spaced apart laterally with the discharge rollers 22 positioned between the two flaps 24, so that the flaps 24 press down the widthwise end portions of the paper 12. The discharge rollers 22, stacker 23, and flaps 24 constitute a medium discharging unit.

Figure 3:
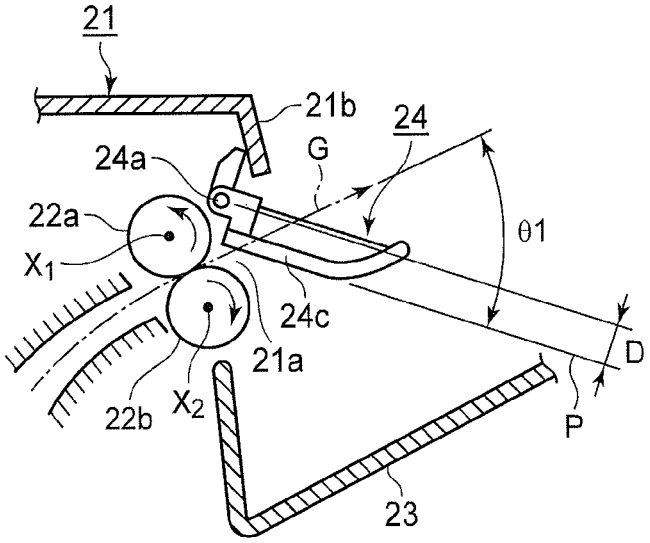
FIG. 3 is a cross-sectional view of the discharge port.
Figure 4:
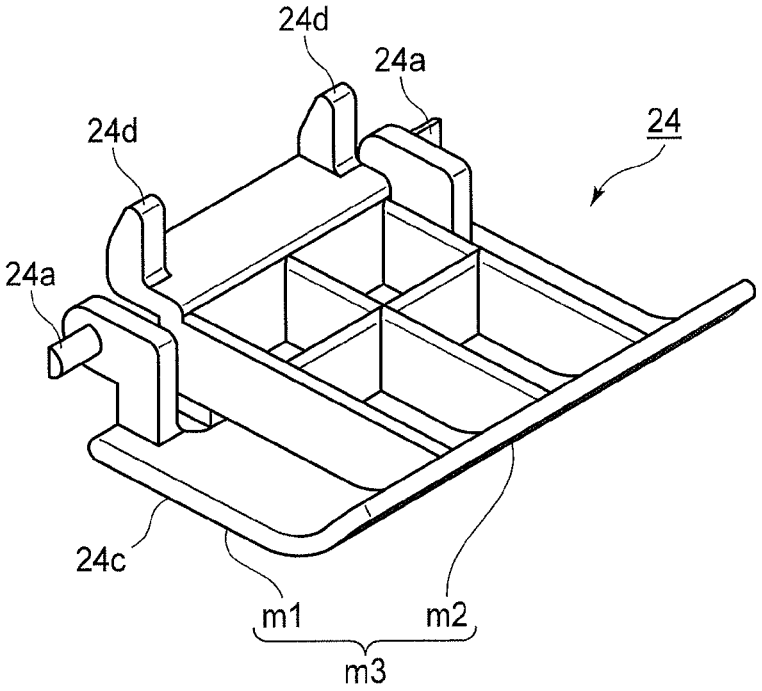
FIG. 4 is a perspective view of the flap.

FIG. 3 is a cross-sectional view of the discharge port 21 and FIG. 4 is a perspective view of the flap 24.

The flaps 24 are located downstream of the discharge rollers 22 with respect to the direction of travel of the paper 12, and are pivotal about shafts 24*a*. The shafts 24*a* are formed in a single-piece construction with the flaps, and project from the flap 24 in directions substantially perpendicular to the direction of travel of the paper 12 being discharged by the discharge rollers 22. The shafts 24*a* are rotatably supported on bearings (not shown). In other words, the shaft 24*a* forms a swing center downstream of the discharge rollers 22 and above a plane G in which the contact area lies. The plane G extends obliquely upwardly and is substantially orthogonal to a plane in which the rotational axes of the transport rollers 24 lie. A top circumferential surface area of the roller 22*a* is tangential to a horizontal plane. A side surface area of the roller 22*b* is tangential to a vertical plane orthogonal to the horizontal plane. The swing center lies in a space bounded by: (i) a downstream half of a first peripheral surface of the roller 22*a* with respect to the direction of travel of the paper 12; (ii) the plane G, which passes through an area at which the rollers 22*a*, 22*b* abut each other; (iii) the horizontal plane that is tangential to the upper half of the top circumferential surface area of the roller 22*a*; and (iv) the vertical plane that is tangential to a downstream half of the side surface area of the roller 22*b* with respect to the direction of travel of the paper 12.

Referring to FIG. 4, each flap 24 has two short projections as stoppers 24*d* near the shafts 24*a* and a main body m3 with a flat portion m1 and a curved-up tip portion m2 contiguous to the flat bottom surface. The flat portion m1 lies in a plane which is substantially parallel to the shaft 24*a* and is spaced apart from the shaft 24*a* by a distance D. The curved-up tip portion m2 extends from the flat portion m1 away from the plane. The flat portion m1 and the curved-up portion m2 form a guide surface 24*c*. The main body m3 has one end portion mounted to the shaft 24*a*, so that the flap 24 can swing on the shaft 24*a* due to gravity in a direction traverse to the transport path of the paper 12.

Referring to FIG. 1, when the flap 24 swings on the shaft 24*a* in a direction toward the transport path, the stoppers 24*d* also swing on the shaft 24*a* in the same direction until the stoppers 24*d* abut a part of an inner wall of the discharge port 21, thereby preventing the flap 24 from further swinging. As a result, if the paper 12 is absent from the transport path, the flap 24 stays at a stop position at which the main body m3 obliquely downward traverses the transport path, entering the transport path lying in the plane G. When the flap 24 is at the stop position, the flat portion m1 extends generally in a direction at an angle θ1 with the plane G. The angle θ1 is selected to be in a range of 43 to 53 degrees. In the first embodiment, the angle θ1 is 48 degrees.

When simplex printing is performed on the paper 12, the paper 12 is not likely to be curled. As the discharge rollers 22 rotate to discharge the paper 12, the leading end of the paper 12 interferes with the flaps 24 and the flaps 24 exert a pressing force on the paper 12, so that the paper smoothly lands onto the stacker by gravity. The stacker 23 has a leading end closer to the paper exit 21*a* and a trailing end remote from the paper exit 21*a*. The stacker 23 has a substantially flat bottom wall inclined such that the leading end is lower than the paper exit 21*a* and the trailing end is higher than the paper exit 21*a*. Therefore, the paper 12 landed onto the stacker 23 may slide down toward the paper exit 21*a* so that the trailing ends of sheets of the paper 12 are evenly aligned.

When duplex printing is performed on the paper 12, the paper 12 is likely to curl. The direction in which the paper 12 curls depends on the alignment of fibers of the paper, the moisture absorbing level, the outer diameter of the heat roller 19*a*, and the amount of heat added to the paper 12.

Figure 5:
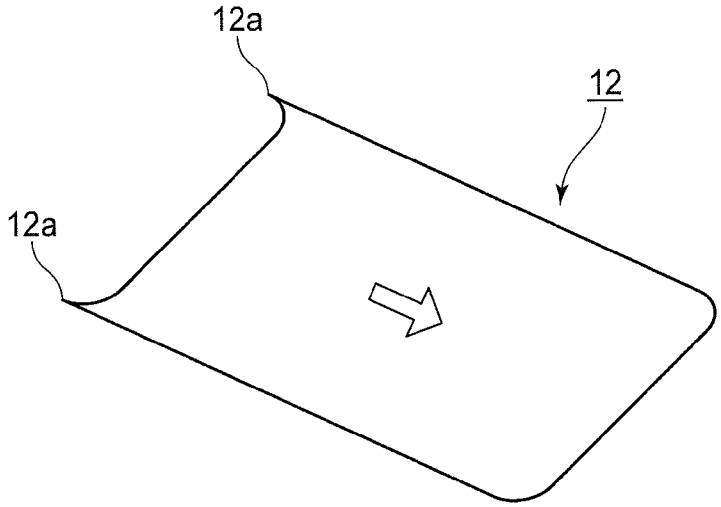
FIG. 5 illustrates the paper curled in one manner.
Figure 6:
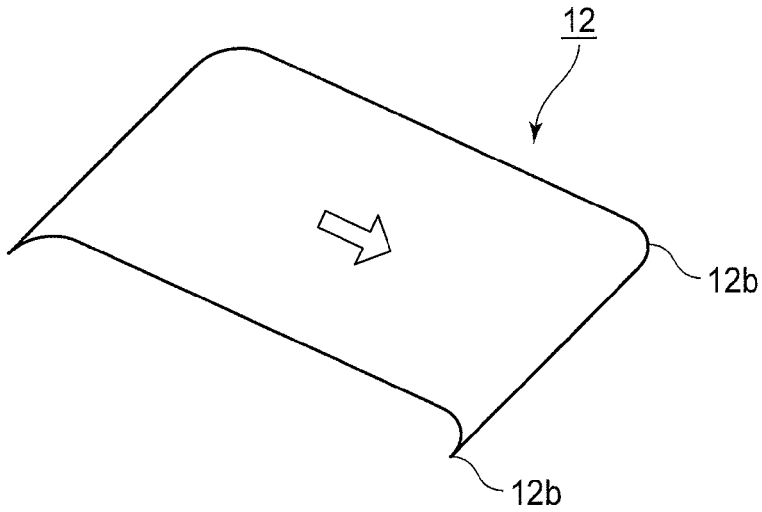
FIG. 6 illustrates the paper curled in another manner.

FIG. 5 illustrates the paper 12 curled in one manner and FIG. 6 illustrates the paper 12 curled in another manner.

The paper 12 is discharged from the paper exit 21*a* in a direction shown by white arrows. The paper 12 shown in FIG. 5 curls upward at its left and right sides, the trailing ends being particularly raised upward at the left and right corners 12*a*.

The paper 12 shown in FIG. 6 curls downward at its leading and trailing end portions, the leading ends being particularly curled downwardly at the left and right corners.

A description will be given of the operation of the flaps 24 when the paper 12 curls downwardly at its trailing end portions as shown in FIG. 5.

Figure 7:
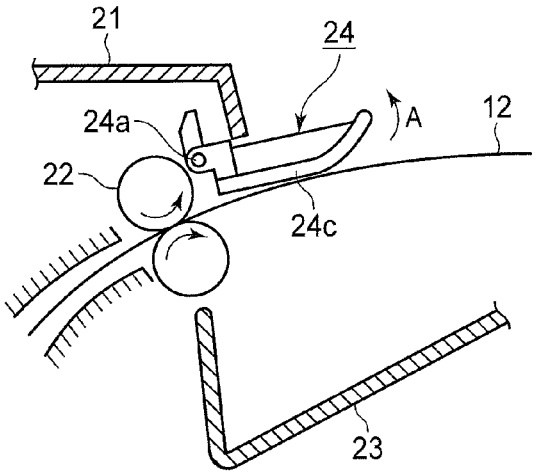
FIG. 7 illustrates the position of the flap when the paper is being discharged by the discharge rollers.

FIG. 7 illustrates the position of the flap 24 when the paper 12 is being discharged by the discharge rollers 22.

Figure 8:
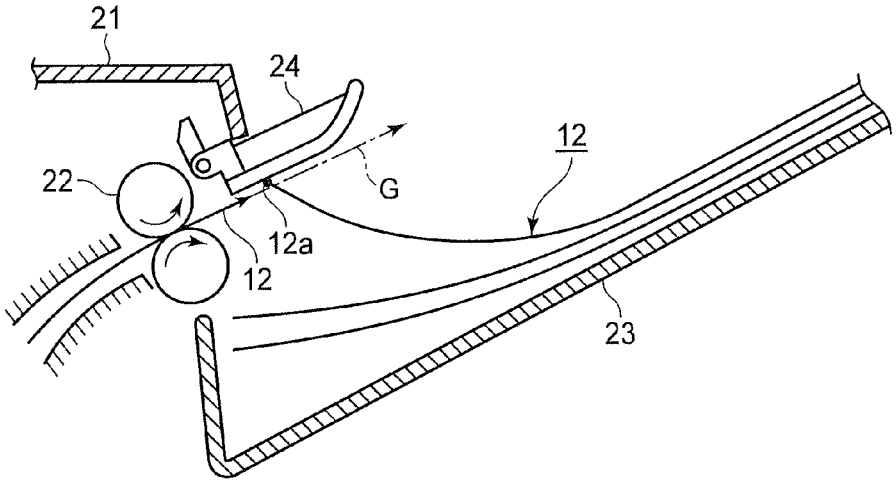
FIG. 8 illustrates the position of the flap when the trailing end of the paper has left the discharge rollers and is pressed downward.

FIG. 8 illustrates the position of the flap 24 when the trailing end of the paper 12 has left the discharge rollers 22 and is pressed downward.

Figure 9:
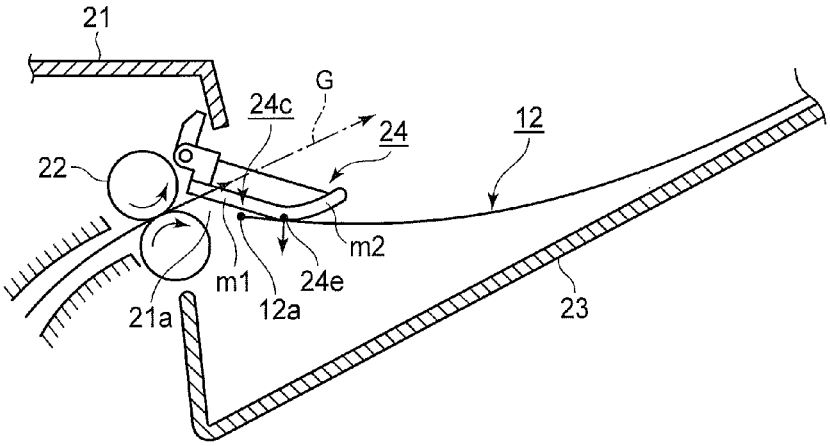
FIG. 9 illustrates the operation of the flap when the weight of the flap is not large enough.

FIG. 9 illustrates the operation of the flap 24 when the weight of the flap 24 is not large enough.

Referring to FIG. 7, when the discharge rollers 22 are rotated in directions shown by arrows, the paper 12 is discharged and the leading end of the paper 12 interferes with the flaps 24 so that the flaps 24 exert a pressing force on the paper 12. The leading end of the paper 12 pushes up the guide surfaces 24*c* of the flaps 24, causing the flaps 24 to pivot about the shafts 24*a* in a direction shown by arrow A. However, the flaps 24 exert gravitational forces on the paper 12, exerting a pressing force on the paper 12 toward the bottom wall of the stacker 23.

Referring to FIG. 8, shortly after the trailing end of the paper 12 leaves through the discharge rollers 22, a curved portion 24*e* is formed between the flat portion m1 and the curved-up tip portion m2 and is contiguous to the flat portion m1 and the curved-up tip portion m2. The curved portion 24*e* smoothly presses down the left and right corners 12*a* (FIG. 5) of the paper 12, so that the trailing end portion of the paper 12 smoothly sinks below the plane G.

After the paper 12 has sat on the stacker 23, the next sheet of paper 12 is discharged. Since the highest portions of the trailing end of the preceding sheet, i.e., the left and right corners 12*a*, have been pressed down below the plane G, the leading end of the following sheet can smoothly discharged onto the preceding sheet on the stacker 23.

Referring to FIG. 9, if the weight of the flap 24 is not large enough, the trailing end of the preceding sheet may remain within the plane G, the following sheet may enter under the preceding sheet, pushing the training end portion of the preceding sheet so that the preceding sheet may fall off the stacker 23.

The weight of the flap 24 is selected to ensure that the trailing end of the preceding sheet is pressed down well below the plane G, thereby preventing the drawback shown in FIG. 9.

A description will be given of the operation of the flaps 24 when the paper 12 curls downwardly at its leading and trailing end portions as shown in FIG. 6.

Figure 10:
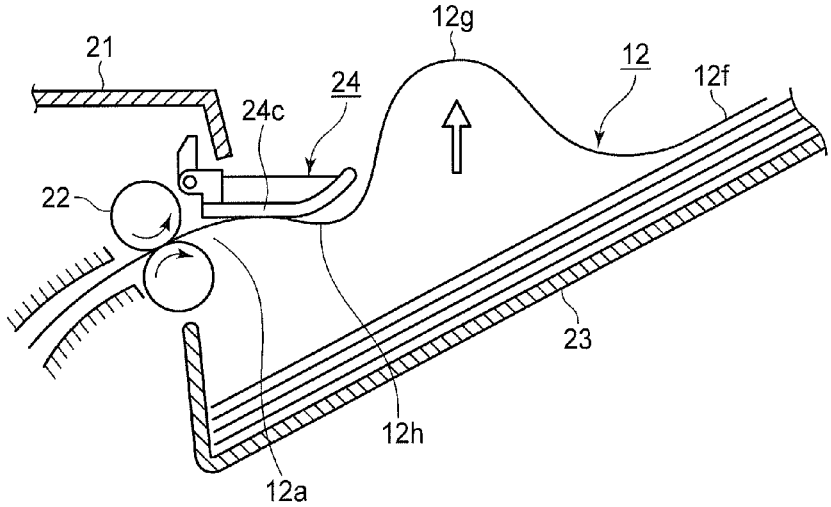
FIG. 10 illustrates the operation of the flap when the paper is discharged after duplex printing.

FIG. 10 illustrates the operation of the flap 24 when the paper 12 is discharged after duplex printing. As the paper 12 is discharged by the discharge rollers 22, the leading end of the paper 12 pushes the guide surfaces 24*c* of the flaps 24 so that the flaps 24 pivot about the shafts 24*a* in a direction shown by arrow. However, the gravitational force of the flaps 24 press down the paper 12 toward the stacker 23.

If the leading end portion of the paper 12 has curved downward, the angle θ2 formed between the leading end portion and the preceding sheet of the paper 12 is larger than when the leading end portion of the paper 12 has curved upward. This creates large friction between the preceding sheet and the following sheet.

As a result, the trailing end of the following sheet pushes the preceding sheet so that the preceding sheet may fall off the stacker 23.

In the first embodiment, the flaps 24 press down the paper 12 toward the stacker 23, decreasing the angle θ2 to minimize the chance of the preceding sheet of falling off the stacker 23.

The relationships among the force exerted by each flap 24 on the paper 12, the weight of the flap 24, and the improper stacking of the paper 12 will be described.

TABLE 1

| PRESSING FORCE P (g) | WEIGHT OF FLAP M (g) | TYPES OF IMPROPER STACKING OF PAPER: PUSHING OUT PRECEDING SHEET | TYPES OF IMPROPER STACKING OF PAPER: ENTER UNDER PRECEDING SHEET |
|---|---|---|---|
| 1.7 | 3.0 | YES | NO |
| 1.8 | 3.2 | NO | NO |
| 2.0 | 3.5 | NO | NO |
| 2.3 | 4.0 | NO | NO |
| 2.7 | 4.8 | NO | NO |
| 2.9 | 5.2 | NO | YES |
| 3.3 | 5.8 | NO | YES |
| 3.4 | 6.0 | NO | YES |
| 5.5 | 9.7 | NO | YES |

Printing was performed on two types of the paper 12: paper having a small ream weight and tending to curl as shown in FIG. 5 and paper having a large ream weight and tending to curl as shown in FIG. 6.

Specifically, printing was performed using two types of paper: thin paper having a ream weight of 45 (kg), a basic weight of 64 (g/m$^2$), and a thickness of 70 (μm) and thick paper having a ream weight of 20-200 (kg), a basic weight of 186 (g/m$^2$), and a thickness of 220 (μm). However, other type of paper such as paper having a ream weight in the range of 30 to 200 (kg), a basic weight in the range of 40 to 210 (g/m$^2$), and a thickness in the range of 70 to 400 (μm).

Table 1 lists the pressing force exerted on the paper 12, the weight of the flap 24, and the types of improper stacking of the paper 12. Symbol "NO" indicates that the following sheet does not enter under the preceding sheet or push the preceding sheet from behind. Symbol "YES" indicates that the following sheet enters under the preceding sheet or pushes the preceding sheet from behind. In general, the paper 12 having a relatively small thickness tends to curl as shown in FIG. 5. The paper 12 having a relatively large thickness tends to curl as shown in FIG. 6.

The test printing was performed in an environment of ambient temperature of 26.5° C. and ambient humidity of 46%. The paper 12 was discharged under the following conditions: a transport speed of 162 mm/sec, an inter-page distance of 45 mm, and a transport force of the discharge rollers 22 of 192 g. The transport force of the transfer rollers 22 is selected to be in the range of 100 to 220 g. A paper-pressing force P of the flap 24 acting in a gravitational direction as shown in FIG. 9 is selected such that P=0.565×M where M is the weight of the flap 24.

As is clear from Table 1, entering under the preceding sheet or pushing the preceding sheet from behind will not occur if the paper-pressing force P is in the range of 1.8 to 2.7 g and the weight M is in the range of 3.2 to 4.8 g. With these ranges of the P and M, 130 sheets of the paper 12 were discharged and entering under the preceding sheet or pushing the preceding sheet from behind did not occur.

In the first embodiment, the flap 24 is discharged downstream of the discharge rollers 22 and is adapted to swing so that the flap 24 presses down the paper 12 to exert the gravitational force on the paper 12. This structure is effective in preventing the following sheet from entering under the preceding sheet or the following sheet from pushing the preceding sheet from behind, which enables a large number of sheets to be stacked on the stacker 23. The two flaps 24 exert substantially the same pressing force P at corners of the trailing end portion of the paper 12. This eliminates skew of the discharged sheets of paper 12, allowing the sheets of the paper 12 to be properly aligned.

If printing is performed in a low-humidity environment, the paper 12 acquires static charges, which in turn causes poor stacking performance of the paper 12.

If a low-humidity environment, when the paper 12 passes through the image forming unit 40 (FIG. 2) or the fixing unit 19, the paper 12 may become electrostatically charged and may be discharged without the charges dissipated. A medium formed of a film material, for example, OHP is apt to become electrostatically charged even in an environment of the normal humidity.

Figure 11:
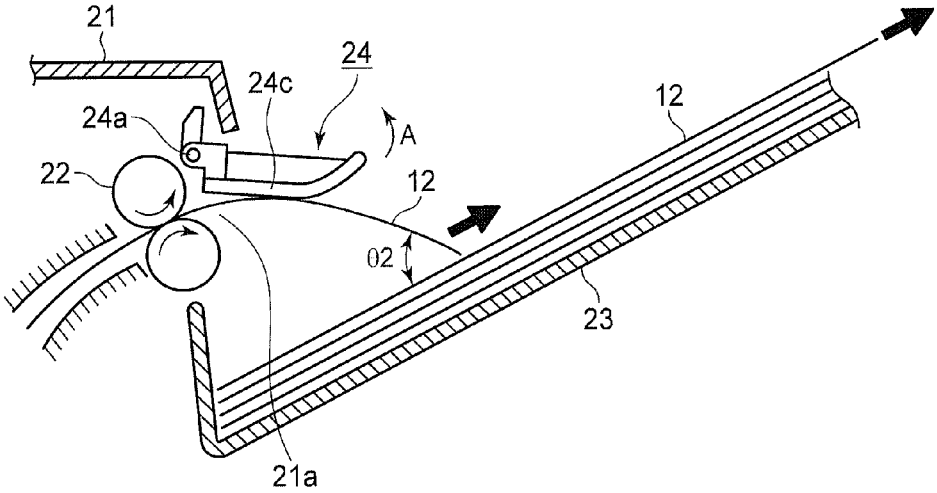
FIG. 11 illustrates the paper discharged while it remains electrostatically charged.

FIG. 11 illustrates the paper 12 discharged while it remains electrostatically charged. If the preceding sheet of the paper 12 discharged from the discharge rollers 22 is charged to a polarity opposite to the following sheet, the leading end portion of the following sheet is electrostatically attracted to the preceding sheet as shown in FIG. 11 so that the middle portion of the following sheet will flex upwardly and a portion 12*h* of the following sheet near the paper exit 21*a* will flex downwardly.

As described above, the gravitational force of the flaps 24 is exerted on the paper 12 to press down the paper 12 toward the stacker 23. This configuration reduces improper stacking of paper on the stacker 23 irrespective of the degree of curl and pliability of the paper 12 and environmental conditions. For example, if the flaps 24 are urged by a spring toward the stacker 23, the urging force of the spring may change due to the degree of curl and pliability of the paper 12 and the environmental conditions. Thus, use of spring will not provide the effect of the present invention.

Second Embodiment

A second embodiment is directed to the smooth discharging of the electrostatically charged paper 12, thereby ensuring the proper stacking of sheets of paper 12 on the stacker 23. Elements similar to those of the first embodiment have been given the same reference numerals and their detailed description is omitted.

Figure 12:
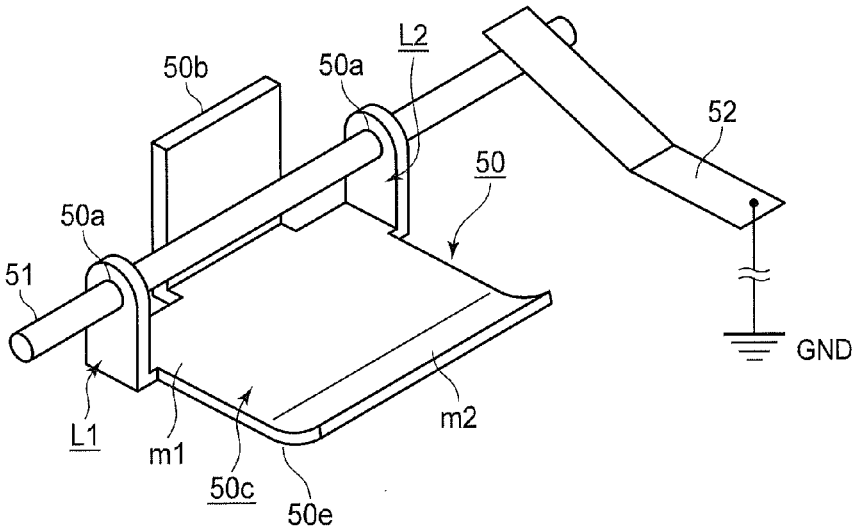
FIG. 12 is a perspective view of a flap according to a second embodiment.

FIG. 12 is a perspective view of a flap 50 according to the second embodiment.

The flap 50 is formed of an electrically conductive material, for example, a metal material, and is disposed at a discharge port 21 at each of substantially widthwise end portions of the paper 12 being discharged from a discharge port. The flaps 50 are adapted to swing freely on a shaft 51 formed of an electrically conductive material, for example, a metal. Each flap 50 is generally in the shape of a bracket having two legs L1 and L2, each leg having a hole 50*a* formed therein.

The flap 50 extends generally in a plane parallel to the shaft 51 having a flat portion m1 and a curved-up portion m2 contiguous to the flat portion m1. Parts 50*b* of the flat portion m1 are angled approximately 90 degrees relative to the flat portion m1 and are aligned substantially in a direction perpendicular to the direction of travel of the paper 12. The angled part 50*b* is on a side of the flat portion m1 opposite the curved-up portion m2. When the flap 50 pivots on the shaft 51 through an angle, the angled parts 50*b* abut the shaft 51 preventing further pivotal motion of the flap 50, so that the flap 50 generally extends into a plane G in which the paper 12 travels when the paper 12 is discharged by discharge rollers 22. When the paper 12 advances in contact with a guide surface 50*c* of the flap 50, the curved boundary 50*e* between the flat portion m1 and the curved-up tip portion m2 smoothly presses down the left and right corners 12*a* (FIG. 5) of the paper 12.

The shaft 51 is formed of a metal material, and has one end portion in pressure contact with a FG plate 52 formed of an electrically conductive material. The FG plate 52 is fixed to apart of the chassis of a printer 11 which serves as a ground (GND) terminal, so that the flap 50 is electrically grounded via the shaft 51, the FG plate 52, and an AC cable (not shown). The two flaps 50 may be mounted on a single common shaft and disposed at a discharge port 21 at substantially widthwise end portions of the paper 12 being discharged from the discharge port, and the FG plate 52 may be disposed at least one end portion of the shaft 51.

In the second embodiment, when the paper 12 passes through an image forming unit 40 or a fixing unit 19, the paper 12 becomes electrostatically charged. The electrostatically charged paper 12 is then discharged by the discharge rollers 22, and the leading end of the paper 12 abuts the guide surfaces 50*c* of the flaps 50. The paper 12 remains in contact with the guide surfaces 50*c* until the trailing end of the paper leaves the discharge rollers 22. In this manner, the electrostatic charges on the paper 12 can be removed via the flap 50, shaft 51, FG plate 52, and AC cable.

In this manner, even if the paper 12 is discharged while it remains electrostatically charged, the paper 12 may be discharged reliably onto the stacker 23, which enhances the ability of the stacker 23 to support the stack of paper 12.

While the embodiment has been described in terms of a printer as an image forming apparatus, the invention may also be applicable to a copying machine, a facsimile machine, and a multifunction peripheral.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A medium discharging apparatus comprising:

a stacker that receives a medium thereon;

a discharging mechanism configured to discharge the medium onto the stacker, the discharging mechanism including a first rotatable body and a second rotatable body disposed such that the second rotatable body is under the first rotatable body and the second rotatable body abuts the first rotatable body, so that the discharging mechanism discharges the medium in a first direction;

a plurality of pressing members, each pressing member being swingable about a swing center thereof, the plurality of pressing members being disposed in a second direction substantially perpendicular to the first direction, the swing center lying in a space bounded by:

(i) a downstream half of a first peripheral surface of the first rotatable body with respect to the first direction, (ii) a first imaginary plane orthogonal to a second imaginary plane passing through a rotational axis of the first rotatable body and a rotational axis of the second rotatable body, the first imaginary plane passing through an area at which the first rotatable body and the second rotatable body abut each other, (iii) a third imaginary plane extending horizontally and being tangential to an upper half of the first peripheral surface of the first rotatable body, and (iv) a fourth imaginary plane extending vertically and being, tangential to a downstream half of a second peripheral surface of the second rotatable body with respect to the first direction, wherein after a leading end of the medium leaves the area, the leading end of the medium first comes into contact with the pressing members, each of the pressing members exerts a gravity force thereof on the medium downward toward the stacker while swinging, wherein the pressing members generally extend to traverse a path in which the medium is discharged, before the medium is discharged by the discharging mechanism, wherein each of the pressing members includes a free end on a side of the pressing member opposite the swing center, and a flat surface which extends away from a vicinity of the swing center substantially toward the free end, and is swingable about the swing center so that the free end moves further away from the first imaginary plane as the pressing members swing, and wherein a downstream portion of each of the flat surfaces with respect to the first direction is movable upward above the first imaginary plane.

2. The medium discharging apparatus according to claim 1, wherein each of the pressing members extends in a direction at an angle with the path.

3. The medium discharging apparatus according to claim 1, wherein the first rotatable body and second rotatable body extend substantially parallel to the second direction;

wherein the first rotatable body and the second rotatable body are in a space between two imaginary planes substantially normal to the second direction and at least one endmost pressing member of the plurality of pressing members is out of the space.

4. The medium discharging apparatus according to claim 3, wherein at least one endmost pressing member of the plurality of pressing members exerts a gravity force thereof on an end portion of the medium in the second direction.

5. The medium discharging apparatus according to claim 1, wherein two endmost pressing members of the plurality of pressing members exert corresponding gravity forces thereof on end portions of the medium in the second direction.

6. The medium discharging apparatus according to claim 5, wherein the two endmost ones of the plurality of pressing members exert substantially equal gravity forces on end portions of the medium in the second direction.

7. The medium discharging apparatus according to claim 6, wherein each of the two pressing members has a weight in the range of 3.2 to 4.8 grams.

8. The medium discharging apparatus according to claim 5, wherein two endmost pressing members of the plurality of pressing members include corresponding shafts which are separate from and substantially in line with each other so that each of the two endmost pressing members of the plurality of pressing members includes at least one corresponding shaft and is swingable about the at least one corresponding shaft.

9. The medium discharging apparatus according to claim 6, wherein each of the two pressing members has a weight smaller than 4.8 grams.

10. The medium discharging apparatus according to claim 1, wherein the discharging mechanism is in a space between two imaginary planes substantially normal to the second direction;

wherein the plurality of pressing members form a row extending in the second direction with a first endmost pressing member at one end of the row and a second endmost pressing member at the other end of the row;

wherein the first endmost pressing member and the second endmost pressing member are out of the space, and the discharging mechanism is between the first endmost pressing member and the second endmost pressing member.

11. The medium discharging apparatus according to claim 10, wherein the first endmost pressing member and the second endmost pressing member exert substantially equal gravity forces on the medium.

12. The medium discharging apparatus according to claim 11, wherein the first and second endmost pressing members of the plurality of pressing members exert the substantially equal gravity forces on end portions of the medium in the second direction.

13. The medium discharging apparatus according to claim 12, wherein each of the first endmost pressing member and the second endmost pressing member has a weight in the range of 3.2 to 4.8 grams.

14. The medium discharging apparatus according to claim 10, wherein the discharging mechanism is one of a plurality of discharging mechanisms disposed in the second direction;

wherein the plurality of discharging mechanisms are in a space between two imaginary planes substantially normal to the second direction, the first endmost pressing member and the second endmost pressing member are out of the space, and the plurality of discharging mechanisms are between the first endmost pressing member and the second endmost pressing member.

15. The medium discharging apparatus according to claim 10, wherein the first endmost pressing member and the second endmost pressing member include corresponding shafts which are separate from and substantially in line with each other so that each of the first endmost pressing member and the second endmost pressing member includes at least one corresponding shaft and is swingable about the at least one corresponding shaft.

16. The medium discharging apparatus according to claim 15, wherein the first endmost pressing member and the second endmost pressing member exert substantially equal gravity forces on end portions of the medium in the second direction.

17. The medium discharging apparatus according to claim 15, wherein the plurality of pressing members are two pressing members.

18. The medium discharge apparatus according to claim 17, wherein each of the two pressing members has a weight smaller than 4.8 grams.

19. The medium discharge apparatus according to claim 10, wherein the plurality of pressing members are two pressing members.

20. The medium discharge apparatus according to claim 19, wherein each of the two pressing members has a weight smaller than 4.8 grams.

21. The medium discharging apparatus according to claim 1, wherein the second rotatable body rotates in contact with the first rotatable body.

22. The medium discharging apparatus according to claim 1, wherein the discharging mechanism is formed of a pair of rollers, one of the pair of rollers being the first rotatable body and the other of the pair of rollers being the second rotatable body.

23. An image forming apparatus incorporating the medium discharging apparatus according to claim 1.

24. The medium discharging apparatus according to claim 1, wherein the medium discharging apparatus includes a first engagement portion and each of the pressing members includes a second engagement portion that abuts the first engagement portion so that the pressing members generally extend at an angle with respect to the first direction.

25. The medium discharging apparatus according to claim 1, wherein the medium is discharged by the discharging mechanism through an exit, wherein the stacker has a leading end closer to the paper exit and a trailing end remote from the paper exit.

26. The medium discharging apparatus according to claim 1, wherein the first direction is an obliquely upward direction.

27. The medium discharge apparatus according to claim 1, wherein the pressing members extend in directions at an acute angle with the first direction.

* * * * *